US009461380B2

(12) United States Patent
Lu et al.

(10) Patent No.: US 9,461,380 B2
(45) Date of Patent: Oct. 4, 2016

(54) CONNECTOR AND CONNECTING PORT ASSEMBLY THEREWITH

(71) Applicant: Wistron Corporation, New Taipei (TW)

(72) Inventors: Li-Chun Lu, New Taipei (TW); Kai-Hsiang Chang, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 14/841,691

(22) Filed: Aug. 31, 2015

(65) Prior Publication Data

US 2016/0134069 A1 May 12, 2016

(30) Foreign Application Priority Data

Nov. 10, 2014 (TW) ..... 103219876 U

(51) Int. Cl.

| | |
|---|---|
| ***H01R 9/16*** | (2006.01) |
| ***H01R 12/70*** | (2011.01) |
| *H01R 107/00* | (2006.01) |
| *H01R 12/71* | (2011.01) |

(52) U.S. Cl.

CPC ..... *H01R 12/707* (2013.01); *H01R 12/716* (2013.01); *H01R 2107/00* (2013.01)

(58) Field of Classification Search

CPC .. H01R 9/16; H01R 12/7011; H01R 12/707; H01R 13/648; H01R 23/688; H01R 23/6873; H01R 23/7063; H01R 23/7057; H01R 12/57

See application file for complete search history.

(56) References Cited

U.S. PATENT DOCUMENTS

| | | | | |
|---|---|---|---|---|
| 6,203,374 | B1 * | 3/2001 | Huang | H01R 12/707 439/571 |
| 6,280,248 | B1 * | 8/2001 | Mitra | H01R 9/091 439/571 |
| 6,343,951 | B1 * | 2/2002 | Ono | H01R 23/6873 439/108 |
| 6,464,515 | B1 * | 10/2002 | Wu | H01R 13/65802 439/108 |
| 6,500,028 | B1 * | 12/2002 | Higuchi | H01R 13/65802 439/567 |
| 6,932,647 | B2 * | 8/2005 | Murayama | H01R 23/6873 439/571 |
| 7,052,286 | B2 * | 5/2006 | Zhang | H01R 23/6873 439/108 |
| 7,309,254 | B2 * | 12/2007 | Suzuki | H01R 12/7052 439/567 |
| 7,320,618 | B2 * | 1/2008 | Tsai | H01R 12/716 439/541.5 |
| 8,801,449 | B2 * | 8/2014 | Huang | H01R 13/648 439/108 |
| 2001/0041475 | A1 * | 11/2001 | Tsuji | 439/570 |
| 2010/0210124 | A1 * | 8/2010 | Li | H01R 23/6873 439/108 |
| 2010/0216338 | A1 * | 8/2010 | Wang | H01R 12/725 439/571 |

* cited by examiner

*Primary Examiner* — Gary Paumen

(74) *Attorney, Agent, or Firm* — Winston Hsu; Scott Margo

(57) ABSTRACT

A connector includes an insulating housing, a signal contact set, a ground contact and a fixing pin. A containing slot is formed on the insulating housing and the insulating housing has an engaging structure located inside the containing slot. The signal contact set is installed inside the insulating housing. The ground contact is installed inside the insulating housing and opposite to the signal contact set. The fixing pin is installed inside the insulating housing and located between the signal contact set and the ground contact. The fixing pin includes a main body, a latching portion and an embedding portion. The main body is installed inside the containing slot. The latching portion protrudes from the main body and is for latching the engaging structure. The embedding portion extends from the main body and is for embedding into a mating hole on a circuit board.

20 Claims, 8 Drawing Sheets

CONNECTOR AND CONNECTING PORT ASSEMBLY THEREWITH

BACKGROUND OF THE INVENTION

1. Field of the Invention

The present invention relates to a connector and a connector port assembly therewith, and more particularly, to a connector capable of fixing onto a circuit board in a Surface Mount Technology (SMT) manner and a connector port assembly therewith.

2. Description of the Prior Art

Generally speaking, a connector adapted to a Voice Over Internet Phone (VoIP) is soldered onto a surface of a circuit board in a Surface Mount Technology manner. Hence, a connection between the aforesaid connector and the circuit board is only implemented on the surface of the circuit board, and is incapable of providing the aforesaid connector with sufficient resistance against pulling. When an external connector coupled to a cable (e.g. RJ 45 connector) is connected to the aforesaid connector and when the cable is pulled by an external force, the connection between the aforesaid connector and the circuit board is incapable of resisting the external force, leading to a crack of solder between the aforesaid connector and the circuit board, or even leading to separation of the aforesaid connector from the circuit board.

SUMMARY OF THE INVENTION

Thus, the present invention provides a connector capable of fixing onto a circuit board and a connector port assembly therewith for solving above drawbacks.

According to an embodiment of the present invention, a connector adapted to a circuit board includes an insulating housing, a signal contact set, a ground contact, a first fixing pin and a second fixing pin. A first containing slot and a second containing slot are formed on the insulating housing, and the insulating housing includes a first engaging structure located in the first containing slot and a second engaging structure located in the second containing slot. The signal contact set is installed inside the insulating housing. The ground contact is installed inside the insulating housing and opposite to the signal contact set. The first fixing pin is installed inside the insulating housing and located between the signal contact set and the ground contact, and the first fixing pin includes a first main body, a first latching portion and a first embedding portion. The first main body is installed in the first containing slot. The first latching portion is for latching the first engaging structure. The first embedding portion extends from the first main body and is for embedding into a first mating hole on the circuit board. The second fixing pin is installed inside the insulating housing, located between the signal contact set and the ground contact and corresponding to the first fixing pin. The second fixing pin includes a second main body, a second latching portion and a second embedding portion. The second main body is installed in the second containing slot. The second latching portion is for latching the second engaging structure. The second embedding portion extends from the second main body and is for embedding into a second mating hole on the circuit board.

According to another embodiment of the present invention, a first positioning slot is further formed on the insulating housing and communicates with the first containing slot. The first fixing pin further includes a positioning structure protruding from the first main body, and the positioning structure cooperates with the first positioning slot, so as to position the first main body in the first containing slot.

According to another embodiment of the present invention, the first main body is substantially a plate structure, the first latching portion and the positioning structure respectively protrude from and are perpendicular to the plate structure, and the first embedding portion is coplanar with the plate structure.

According to another embodiment of the present invention, a distance between a top surface of the first latching portion and a top surface of the plate structure is between 0.2 mm and 0.35 mm, and a distance between an end of the first embedding portion and an edge of the plate structure is between 1.4 mm and 1.42 mm.

According to another embodiment of the present invention, a second positioning slot is further formed on the insulating housing and communicates with the second containing slot. The second fixing pin further includes a constraining structure protruding from the second main body, and the constraining structure cooperates with the second positioning slot, so as to constrain the second main body in the second containing slot.

According to another embodiment of the present invention, the second main body is substantially a sheet structure, the second latching portion and the constraining structure respectively protrude from and are perpendicular to the sheet structure, and the second embedding portion is coplanar with the sheet structure.

According to another embodiment of the present invention, a distance between a top surface of the second latching portion and a top surface of the sheet structure is between 0.2 mm and 0.35 mm, and a distance between an end of the second embedding portion and an edge of the sheet structure is between 1.4 mm and 1.42 mm.

According to another embodiment of the present invention, a length of the first embedding portion is smaller than a thickness of the circuit board, and a length of the second embedding portion is smaller than the thickness of the circuit board.

According to another embodiment of the present invention, the insulating housing has a first lateral wall, a second lateral wall, a third lateral wall and a fourth lateral wall. The first lateral wall is opposite to the second lateral wall, the third lateral wall connects the first lateral wall and the second lateral wall, the fourth lateral wall connects the first lateral wall and the second lateral wall and is opposite to the third lateral wall. The first lateral wall, the second lateral wall, the third lateral wall and the fourth lateral wall cooperatively define a mating opening, which is for mating with an external connector.

According to another embodiment of the present invention, the first containing slot is located on the first lateral wall, the second containing slot is located on the second lateral wall, a third containing slot is formed on the third lateral wall and for containing the signal contact set, a fourth containing slot is formed on the fourth lateral wall and for containing the ground contact. The mating opening communicates with the first containing slot, the second containing slot, the third containing slot and the fourth containing slot.

According to another embodiment of the present invention, a buckling hole is formed on the third lateral wall, and the connector further includes an installing base combined with the signal contact set. The installing base assembles the signal contact set into the third containing slot and has a buckling structure for buckling the buckling hole.

According to another embodiment of the present invention, the insulation housing has a first edge and a second edge opposite to the first edge, and each signal contact of the signal contact set includes a signal abutting portion and a signal connecting portion. The signal abutting portion extends from the first edge, stretches into the mating opening via the third containing slot and is for electrically connected to an external contact of the external connector. The signal connecting portion is connected to the signal abutting portion, extends outward from the second edge and is for electrically connected to a signal pad on the circuit board.

According to another embodiment of the present invention, the ground contact includes a ground abutting portion and a ground connecting portion. The ground abutting portion stretches into the mating opening via the fourth containing slot. The ground connecting portion is connected to the ground abutting portion and for electrically connected to a ground pad on the circuit board.

According to another embodiment of the present invention, an engaging hole is formed on the ground abutting portion, and the fourth lateral wall has an engaging protrusion for engaging with the engaging hole.

According to another embodiment of the present invention, the ground abutting portion has at least one inserting structure for inserting into a slot wall of the fourth containing slot.

According to another embodiment of the present invention, a distance between the first containing slot and the third lateral wall is substantially equal to a distance between the first containing slot and the fourth lateral wall, and a distance between the second containing slot and the third lateral wall is substantially equal to a distance between the second containing slot and the fourth lateral wall.

According to another embodiment of the present invention, a connecting port assembly includes a circuit board and a connector. The circuit board has a first board side. A first mating hole and a second mating hole are formed on the circuit board. The connector is disposed on the first board side and includes an insulating housing, a signal contact set, a ground contact, a first fixing pin and a second fixing pin. A first containing slot and a second containing slot are formed on the insulating housing, and the insulating housing includes a first engaging structure located in the first containing slot and a second engaging structure located in the second containing slot. The signal contact set is installed inside the insulating housing. The ground contact is installed inside the insulating housing and opposite to the signal contact set. The first fixing pin is installed inside the insulating housing and located between the signal contact set and the ground contact, and the first fixing pin includes a first main body, a first latching portion and a first embedding portion. The first main body is installed in the first containing slot. The first latching portion is for latching the first engaging structure. The first embedding portion extends from the first main body and is for embedding into the first mating hole on the circuit board. The second fixing pin is installed inside the insulating housing, located between the signal contact set and the ground contact and corresponding to the first fixing pin. The second fixing pin includes a second main body, a second latching portion and a second embedding portion. The second main body is installed in the second containing slot. The second latching portion is for latching the second engaging structure. The second embedding portion extends from the second main body and is for embedding into the second mating hole on the circuit board.

In summary, the present invention determines the length of the first fixing pin and the length of the second fixing pin according to the thickness of the circuit board, such that the connector is able to fix onto the circuit board in a Surface Mount Technology manner and by reflow process for saving hours of assembling the connector and the circuit board. In addition, the present invention utilizes the first fixing pin and the second fixing pin for inserting into the first mating hole and the second mating hole, and the first embedding portion of the first fixing pin and the second embedding portion of the second fixing pin are soldered to fix in the first mating hole and the second mating hole. As a result, the first fixing pin and the second fixing pin are capable of enhancing connection strength between the insulating housing and the circuit board, so as to facilitate the insulating housing to resist against pulling. The aforesaid connection among the first fixing pin, the second fixing pin and the circuit board is capable of preventing solders between the signal connecting portion of each of the signal contact and the circuit board and between the ground connecting portion of the ground contact and the circuit board from cracking, so as to further prevent the connector from separating from the circuit board.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention maybe practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
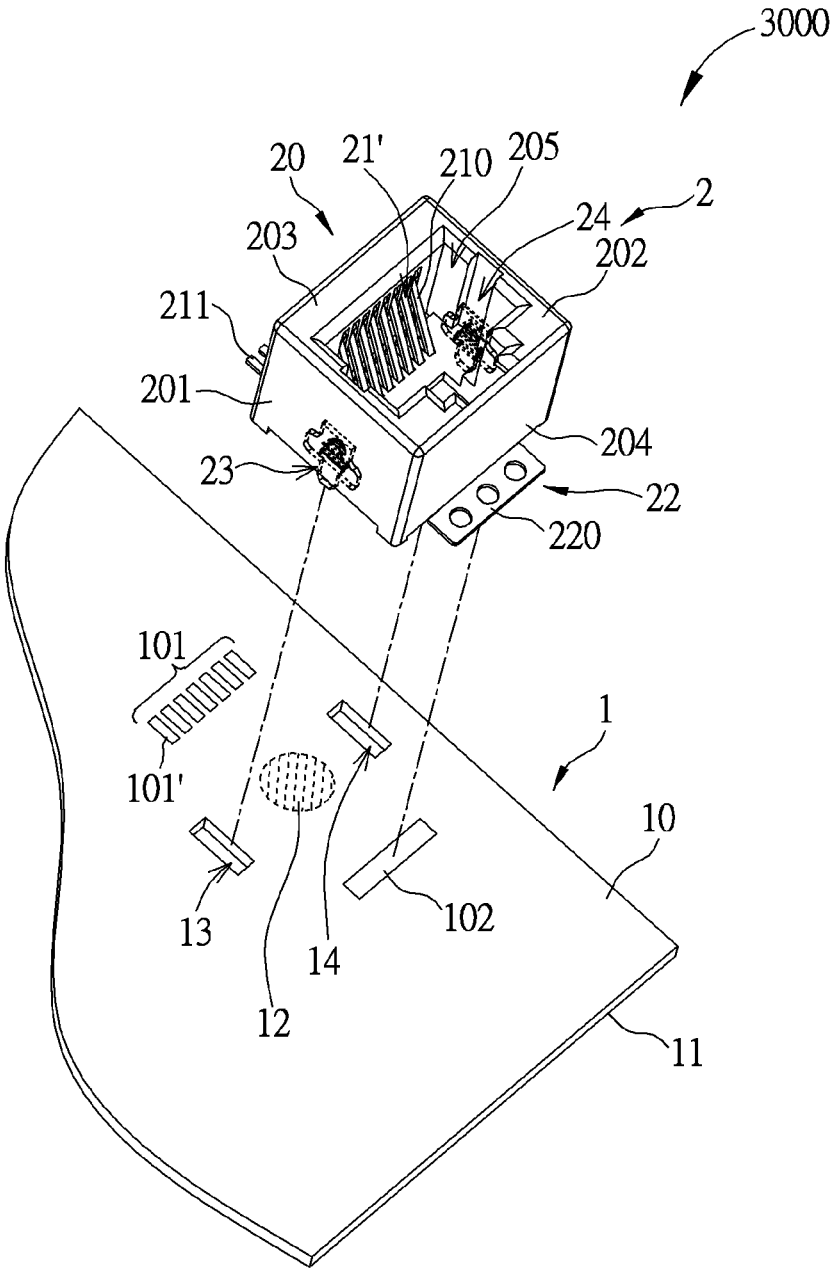
FIG. 1 is an exploded diagram of a connector port assembly according to an embodiment of the present invention.

Please refer to FIG. 1. FIG. 1 is an exploded diagram of a connector port assembly 3000 according to an embodiment of the present invention. As shown in FIG. 1, connector port assembly 3000 includes a circuit board 1 and a connector 2. The circuit board 1 has a first board side 10 and a second board side 11 opposite to the first board side 10. The circuit board 1 includes a switch pad 12 on the second board side 11, and the connector 2 is disposed on the first board side 10 of the circuit board 1, i.e. the switch pad 12 and the connector 2 are disposed on two opposite sides of the circuit board 1. A first mating hole 13 and a second mating hole 14 are formed on the circuit board 1 and located near the switch pad 12. In this embodiment, the connector 2 is an electrical connector adapted to a Voice Over Internet Phone, VoIP, which can be soldered onto the first board side 10 of the circuit board 1 in a Surface Mount Technology (SMT) manner. The present invention is not limited thereto, and it depends on practical demands.

Figure 2:
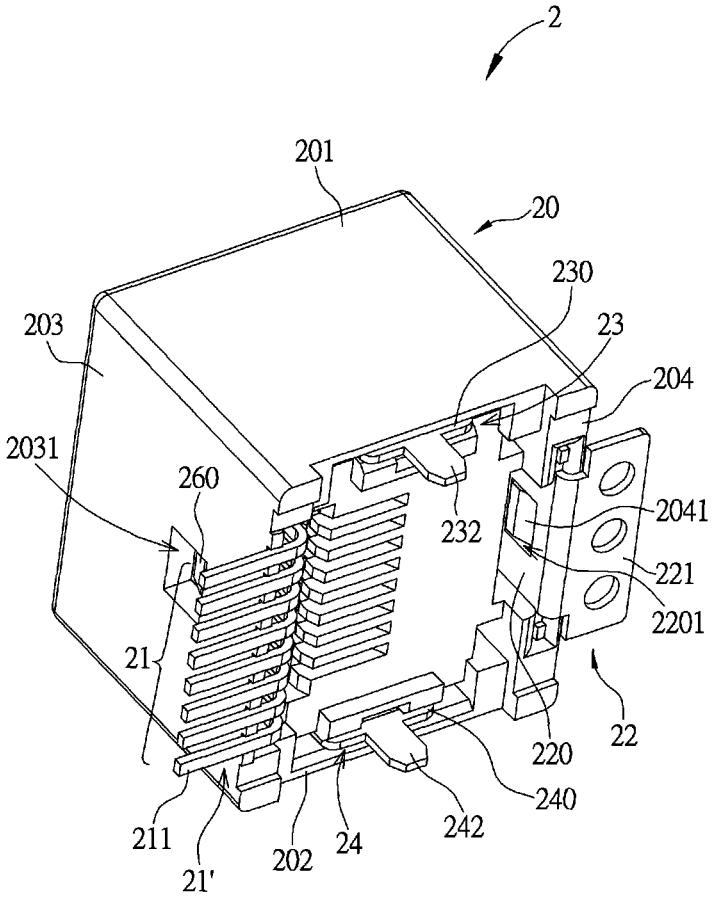
FIG. 2 is a diagram of a connector in another view according to the embodiment of the present invention.
Figure 3:
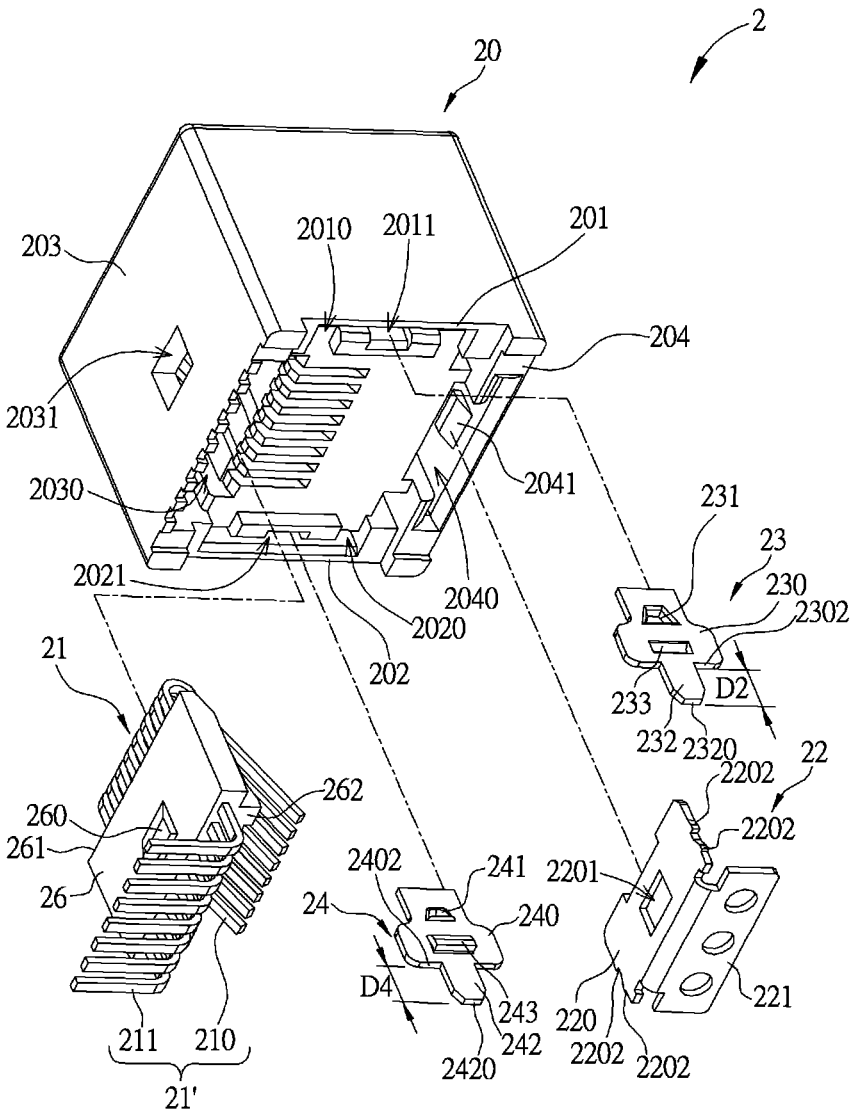
FIG. 3 is an exploded diagram of the connector according to the embodiment of the present invention.
Figure 4:
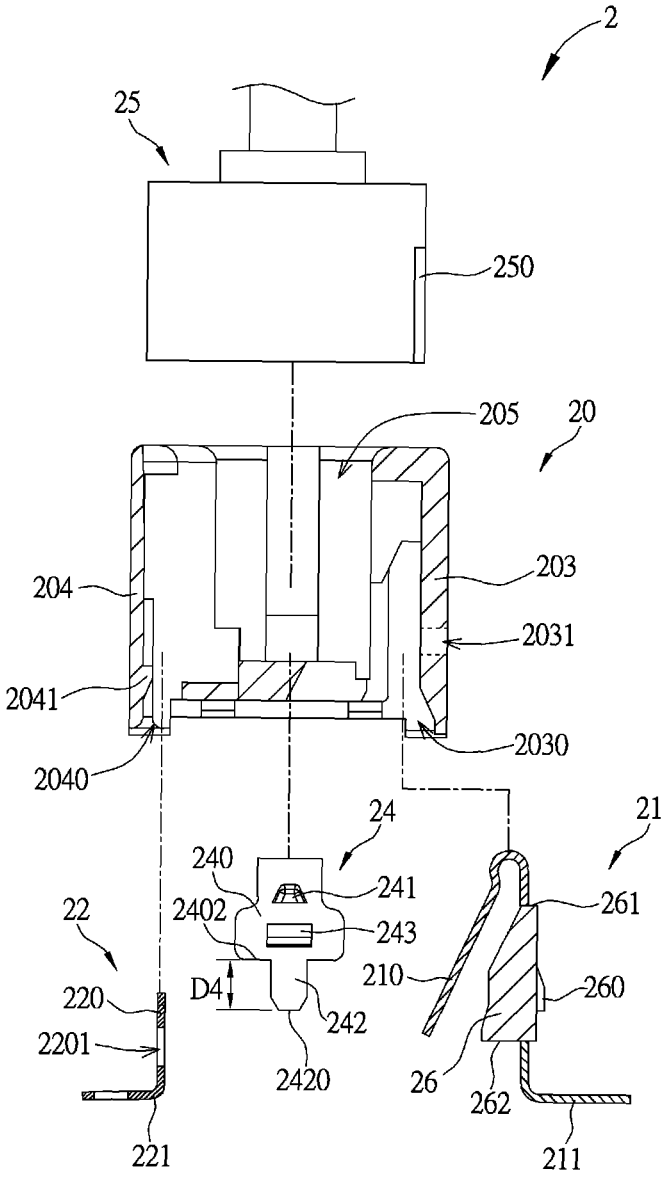
FIG. 4 is an exploded sectional diagram of the connector according to the embodiment of the present invention.
Figure 5:
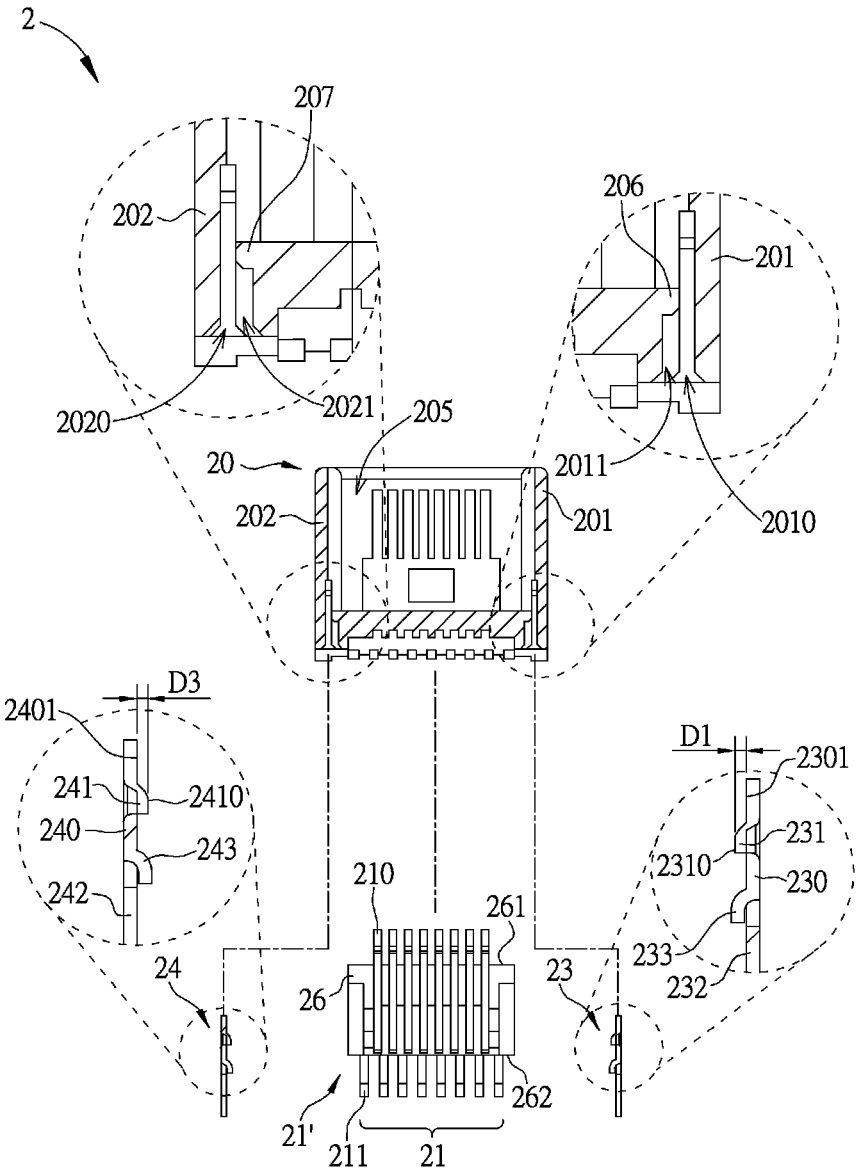
FIG. 5 is an exploded sectional diagram of the connector in another view according to the embodiment of the present invention.

Please refer to FIG. 1 to FIG. 5. FIG. 2 is a diagram of the connector 2 in another view according to the embodiment of the present invention. FIG. 3 is an exploded diagram of the connector 2 according to the embodiment of the present invention. FIG. 4 is an exploded sectional diagram of the connector 2 according to the embodiment of the present invention. FIG. 5 is an exploded sectional diagram of the connector 2 in another view according to the embodiment of the present invention. As shown in FIG. 1 to FIG. 5, the connector 2 includes an insulating housing 20, a signal contact set 21, a ground contact 22, a first fixing pin 23 and a second fixing pin 24. The insulating housing 20 has a first lateral wall 201, a second lateral wall 202, a third lateral wall 203 and a fourth lateral wall 204. The first lateral wall 201 is opposite to the second lateral wall 202, and the third lateral wall 203 connects the first lateral wall 201 and the second lateral wall 202. The fourth lateral wall 204 connects the first lateral wall 201 and the second lateral wall 202 and is opposite to the third lateral wall 203. The first lateral wall 201, the second lateral wall 202, the third lateral wall 203 and the fourth lateral wall 204 cooperatively define a mating opening 205, which is for mating with an external connector 25, as shown in FIG. 4. In other words, the external connector 25 is detachably mated with the insulating housing 20 of the connector 2 via the mating opening 205.

In this embodiment, the first fixing pin 23 and the second fixing pin 24 are pin-shaped structures, but the present invention is not limited thereto. For example, the first fixing pin 23 and the second fixing pin 24 can be plate-shaped structures as well. As for which one of the above-mentioned designs is adopted, it depends on practical demands. A first containing slot 2010 is formed on the first lateral wall 201 of the insulating housing 20, and a second containing slot 2020 is formed on the second lateral wall 202.A third containing slot 2030 is formed on the third lateral wall 203, and a fourth containing slot 2040 is formed on the fourth lateral wall 204. The mating opening 205 communicates with the first containing slot 2010, the second containing slot 2020, the third containing slot 2030 and the fourth containing slot 2040. The third containing slot 2030 is for containing the signal contact set 21, such that the signal contact set 21 is installed inside the insulating housing 20. The fourth containing slot 2040 is for containing the ground contact 22, such that the ground contact 22 is installed inside the insulating housing 20 and opposite to the signal contact set 21.

Furthermore, a buckling hole 2031 is formed on the third lateral wall 203 of the insulating housing 20, and the connector 2 further comprises an insulating base 26 combined with the signal contact set 21. In practical application, the insulating base 26 and the signal contact set 21 are integrally formed in an insert molding manner, but the present invention is not limited thereto. In addition, the insulating base 26 can have a buckling structure 260. When the insulating housing 20 is assembled in the third containing slot 2030, the buckling structure 260 of the insulating base 26 is used for buckling the buckling hole 2031 on the third lateral wall 203 of the insulating housing 20, so as to prevent the insulating base 26 from separating from the third containing slot 2030. In such a manner, the insulating base 26 is able to assemble and fix the signal contact set 21 in the third containing slot 2030 on the third lateral wall 203.

As shown in FIG. 1 to FIG. 5, the circuit board 1 comprises a signal pad set 101 on the first board side 10, i.e. the signal pad set 101 and the switch pad 12 are disposed on two opposite sides of the circuit board 1, and the signal pad set 101 is located near a position where the switch pad 12 is projected to the first board side 10. The insulating base 26 has a first edge 261 and a second edge 262 opposite to the first edge 261. Each signal contact 21' of the signal contact set 21 comprises a signal abutting portion 210 and a signal connecting portion 211. The signal abutting portion 210 extends from the first edge 261 of the insulating base 26, and the signal connecting portion 211 is connected to the signal abutting portion 210 and extends outward from the second edge 262. Since the mating opening 205 communicates with the third containing slot 2030 on the third lateral wall 203, each of the signal contacts 21' is able to stretch into the mating opening 205 via the third containing slot 2030 when assembling the signal contact set 21 and the insulating housing 20. In such a manner, when the external connector 25 is mated inside the mating opening 205 of the insulating housing 20, the signal abutting portion 210 of each of the signal contacts 21' is able to electrically abut against an external contact 250 of the external connector 25, as shown in FIG. 4.

Furthermore, since the signal connecting portion 211 of each of the signal contacts 21' extends outward from the second edge 262 of the insulating base 26, the signal connecting portion 211 of the signal contact 21' is able to be exposed and extend from the insulating housing 20 when the signal abutting portion 210 of the signal contact 21' is installed in the third containing slot 2030. Accordingly, the signal connecting portion 211 is able to be soldered and fixed on the first board side 10 of the circuit board 1 in the SMT manner. In such a manner, when the external connector 25 is mated with the insulating housing 20, the external contact 250 of the external connector 25 is able to be electrically connected to s signal pad 101' of the signal pad set 101 via the signal abutting portion 210 and the signal connecting portion 211 of each of the signal contacts 21'.

In addition, the circuit board 1 further includes a ground pad 102 on the first board side 10, i.e. the ground pad 102 and the switch pad 12 of the present invention are located on two opposite sides of the circuit board 1, and the ground pad 102 is located near a position where the switch pad 12 is projected to the first board side 10. The ground contact 22 includes a ground abutting portion 220 and a ground connecting portion 221, and the ground connecting portion 221 is connected to the ground abutting portion 220. In this embodiment, the ground connecting portion 221 is substantially perpendicular to the ground abutting portion 220. Since the mating opening 205 communicates with the fourth containing slot 2040 on the fourth lateral wall 204, the ground abutting portion 220 of the ground contact 22 is able to stretch into the mating opening 205 via the fourth containing slot 2040 when assembling the ground contact 22 and the insulating housing 20. In such a manner, when the external connector 25 mates with the mating opening 205 of the insulating housing 20, the ground abutting portion 220 of the ground contact 22 is electrically connected to a connecting contact (not shown in figures) of the external connector 25.

Since the ground connecting portion 221 of the ground contact 22 is substantially perpendicular to the ground abutting portion 220, the ground connecting portion 221 of the ground contact 22 is able to stretch outward from the insulating housing 20 when the ground abutting portion 220 of the ground contact 22 is assembled in the fourth containing slot 2040. Accordingly, the ground connecting portion 221 is able to soldered and fixed onto the ground pad 102 on the first board side 10 of the circuit board 1 in a SMT manner. In such a manner, when the external connector 25 mates with insulating housing 20, the ground contact of the external connector 25 is electrically connected to ground pad 102 of the circuit board 1 via the ground abutting portion 220 and the ground connecting portion 221 of the ground contact 22.

It should be noticed that the ground abutting portion 220 has an engaging hole 2201 formed thereon and four inserting structures 2202, as shown in FIG. 3. The fourth lateral wall 204 of the insulating housing 20 has an engaging protrusion 2041. When the ground abutting portion 220 of the ground contact 22 is installed in the fourth containing slot 2040, the engaging protrusion 2041 of the fourth lateral wall 204 is used for engaging with the buckling hole 2201 on the ground abutting portion 220, so as to prevent the ground contact 22 from separate from the fourth containing slot 2040, and each of the inserting structures 2202 is used for inserting into a slot wall of the fourth containing slot 2040, so as to fix the ground contact 22 onto the fourth lateral wall 204. An amount and configuration of the inserting structures 2202 is not limited to those illustrated in figures in this embodiment. The ground abutting portion 220 can include only one inserting structure 2202 as well, i.e. structures that the ground abutting portion 220 includes at least one inserting structure 2202 is within the scope of the present invention.

As shown in FIG. 3 to FIG. 5, the first fixing pin 23 includes a first main body 230, a first latching portion 231, a first embedding portion 232 and a positioning structure 233. The first main body 230 is installed in the first containing slot 2010 and substantially a plate structure. The first latching portion 231 and the positioning structure 233 respectively protrude from and are perpendicular to the plate structure, i.e. both of the first latching portion 231 and the positioning structure 233 protrude from the first main body 230. The first embedding portion 232 extends from the first main body 230 and coplanar with the plate structure (i.e. the first main body 230). Furthermore, the first latching portion 231 and the positioning structure 233 are located on the same side of the first main body 230. A distance D1 is between a top surface 2310 of the first latching portion 231 and a top surface 2301 of the plate structure, and a distance D2 is between an end 2320 of the first embedding portion 232 and an edge 2302 of the plate structure. In this embodiment, the distance D1 between the top surface 2310 of the first latching portion 231 and the top surface 2301 of the plate structure is between 0.2 mm and 0.35 mm. The distance D2 between the end 2320 of the first embedding portion 232 and the edge 2302 of the plate structure is preferably 1.4 mm, but the present invention is not limited thereto. For example, the distance D2 between the end 2320 of the first embedding portion 232 and the edge 2302 of the plate structure can be between 1.4 mm and 1.42 mm as well.

As shown in FIG. 3 and FIG. 5, the second fixing pin 24 includes a second main body 240, a second latching portion 241, a second embedding portion 242 and a constraining portion 243. The second main body 240 is installed in the second containing slot 2020 and substantially a sheet structure. The second latching portion 241 and the constraining portion 243 respectively protrude from and are perpendicular to the sheet structure, i.e. both of the second latching portion 241 and the constraining portion 243 protrude from the second main body 240. The second embedding portion 242 extends from the second main body 240 and coplanar with the sheet structure (i.e. the second main body 240). Furthermore, the second latching portion 241 and the constraining portion 243 are located on the same side of the second main body 240. A distance D3 is between a top surface 2410 of the second latching portion 241 and a top surface 2401 of the sheet structure, and a distance D4 is between an end 2420 of the second embedding portion 242 and an edge 2402 of the sheet structure. In this embodiment, the distance D3 between the top surface 2410 of the second latching portion 241 and the top surface 2401 of the sheet structure is between 0.2 mm and 0.35 mm. The distance D4 between the end 2420 of the second embedding portion 242 and the edge 2402 of the sheet structure is preferably 1.4 mm, but the present invention is not limited thereto. For example, the distance D3 between the end 2420 of the second embedding portion 242 and the edge 2402 of the sheet structure can be between 1.4 mm and 1.42 mm as well.

Figure 6:
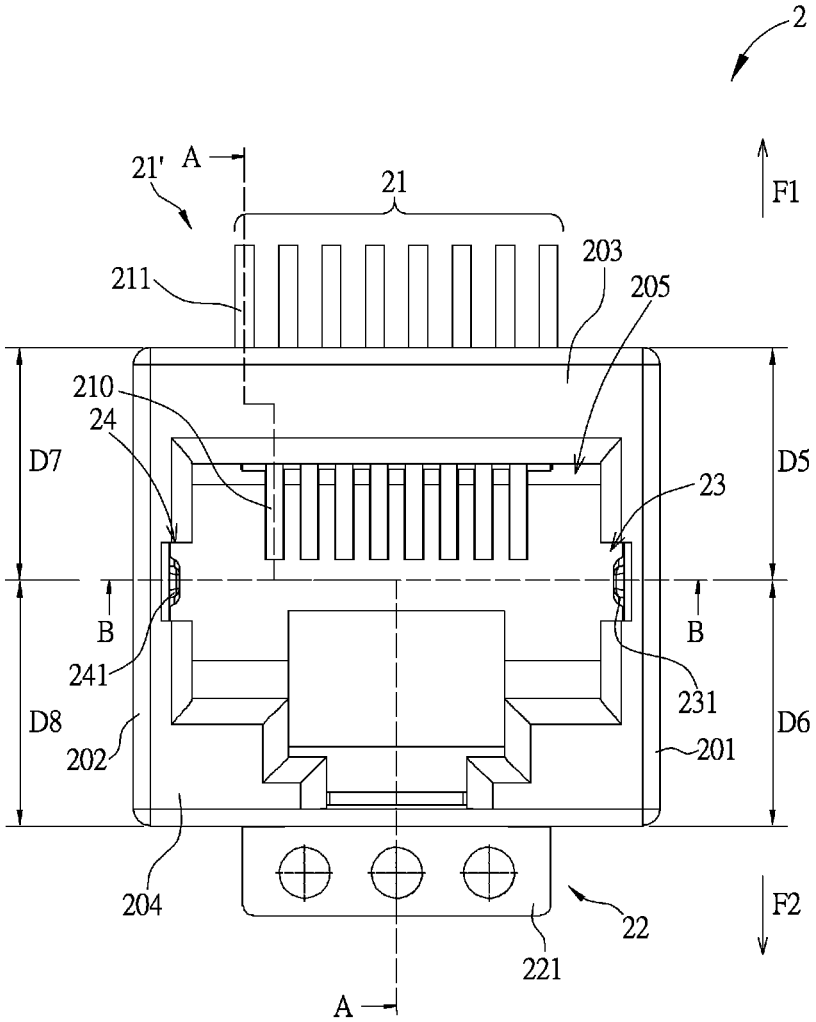
FIG. 6 is a top view of the connector in an engaged status according to the embodiment of the present invention.
Figure 7:
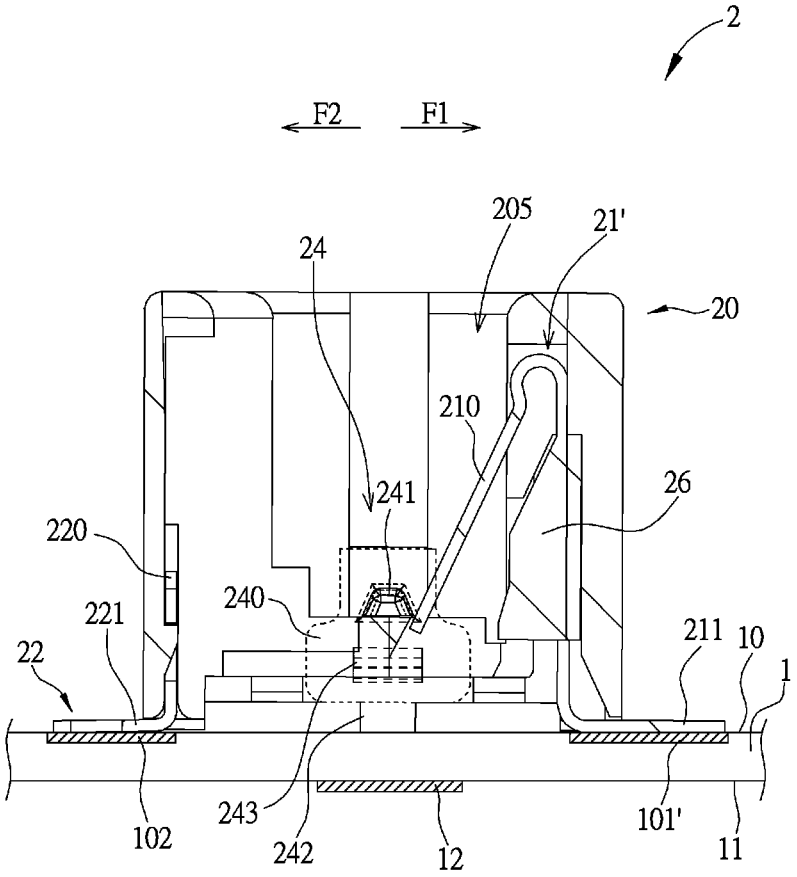
FIG. 7 is a sectional diagram of the connector along section line A-A in FIG. 6.
Figure 8:
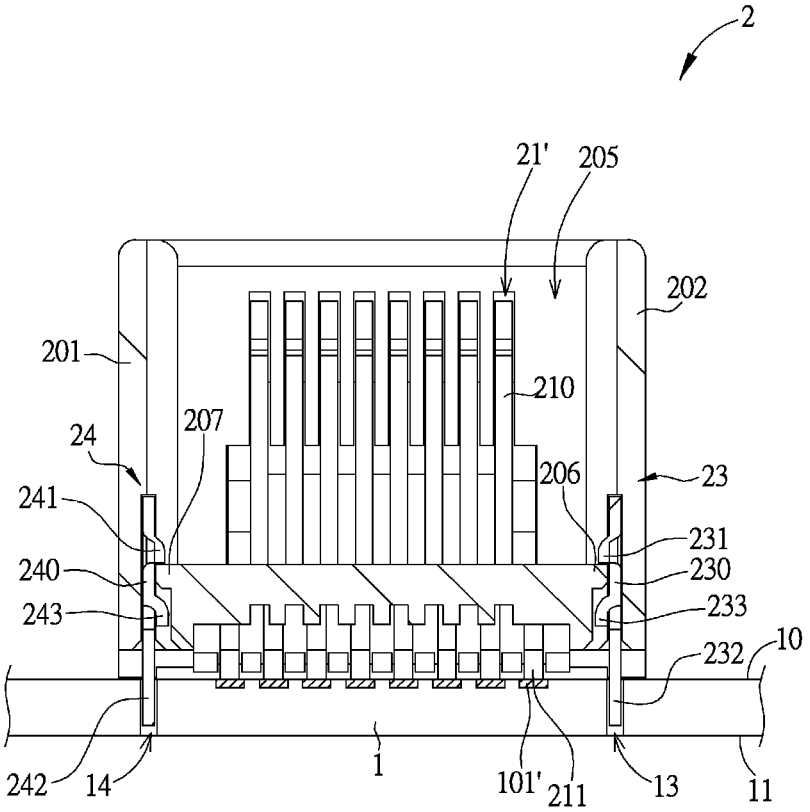
FIG. 8 is a sectional diagram of the connector along section line B-B in FIG. 6.

Please refer to FIG. 3 to FIG. 8. FIG. 6 is a top view of the connector 2 in an engaged status according to the embodiment of the present invention. FIG. 7 is a sectional diagram of the connector 2 along section line A-A in FIG. 6. FIG. 8 is a sectional diagram of the connector 2 along section line B-B in FIG. 6. As shown in FIG. 3 to FIG. 8, a first positioning slot 2011 is further formed on the first lateral wall 201 of the insulating housing 20 and communicates with the first containing slot 2010. A second positioning slot 2021 is further formed on the second lateral wall 202 of the insulating housing 20 and communicates with the second containing slot 2020. The insulating housing 20 further includes a first engaging structure 206 and a second engaging structure 207. The first engaging structure 206 is located in the first containing slot 2010, and the second engaging structure 207 is located in the second containing slot 2020.

During process that the first fixing pin 23 is installed in the first containing slot 2010, the positioning structure 233 of the first fixing pin 23 cooperates with the first positioning slot 2011, so as to position the first main body 230 of the first fixing pin 23 in the first containing slot 2010. As a result, the first latching portion 231 of the first fixing pin 23 stretches into the mating opening 205 via the first containing slot 2010 and is for latching the first engaging structure 206, so as to prevent the first main body 230 from separating from the first containing slot 2010. Accordingly, the first fixing pin 23 is able to be fixed onto the first lateral wall 201 of the insulating housing 20. Namely, during process that the second fixing pin 24 is installed in the second containing slot 2020, the constraining portion 243 of the second fixing pin 24 cooperates with the second positioning slot 2021, so as to position the second main body 240 of the second fixing pin 24 in the second containing slot 2020. As a result, the second latching portion 241 of the second fixing pin 24 stretches into the mating opening 205 via the second containing slot 2020 and is for latching the second engaging structure 207, so as to prevent the second main body 240 from separating from the second containing slot 2020. Accordingly, the second fixing pin 24 is able to be fixed onto the second lateral wall 202 of the insulating housing 20.

When assembling the connector 2 and the circuit board 1, the first embedding portion 232 of the first fixing pin 23 of the connector 2 is embedded into the first mating hole 13 from the first board side 10 of the circuit board 1, and the second embedding portion 242 of the second fixing pin 24 of the connector 2 is embedded into the second mating hole 14 from the first board side 10 of the circuit board 1, respectively. As a result, the signal connecting portion 211 of each of the signal contacts 21' of the connector 2 bridges and abuts against the signal pad 101' on the first board side 10 of the connector 2, and the ground connecting portion 221 of each of the ground contacts 22 of the connector 2 bridges and abuts against the ground pad 102 on the first board side 10 of the connector 2. In such a manner, the first board side 10 of the circuit board 1 can be passed through reflow oven for making the signal connecting portion 211 of each of the signal contacts 21' and ground connecting portion 221 of each of the ground contacts 22 be soldered and fixed onto the signal pad 101' and the ground pad 102 of the circuit board, respectively.

As mentioned above, in this embodiment, the distance D2 between the end 2320 of the first embedding portion 232 and the edge 2302 of the plate structure and the distance D4 between the end 2420 of the second embedding portion 242 and the edge 2402 of the sheet structure are substantially equal to 1.4 mm. In practical application, a thickness of the circuit board 1 is 1.6 mm, i.e. a length of the first embedding portion 232 and a length of the second embedding portion 242 are smaller than the thickness of the circuit board 1. As a result, when the first embedding portion 232 is embedded into the first mating hole 13 and when the second embedding portion 242 is embedded into the second mating hole 14, the end 2320 of the first embedding portion 232 and the end 2420 of the second embedding portion 242 do not exceed and protrude from the second board side 11 of the circuit board 1, as shown in FIG. 8. In such a manner, the reflow process for the first board side 10 of the circuit board 1 is able to solder and fix the first embedding portion 232 and the second embedding portion 242 in the first mating hole 13 and the second mating hole 14 simultaneously.

As shown in FIG. 6 to FIG. 8, since the first fixing pin 23 and the second fixing pin 24 are installed on the circuit board 1 in a mounting manner and the first embedding portion 232 of the first fixing pin 23 and the second embedding portion 242 of the second fixing pin 24 are fixed in the first mating hole 13 and the second mating hole 14 by reflowing process, the first fixing pin 23 and the second fixing pin 24 are capable of enhancing connection strength between the insulating housing 20 and the circuit board 1. Accordingly, the first fixing pin 23 and the second fixing pin 24 of the connector 2 of the present invention facilitates the insulating housing 20 to resist against pulling. In such a manner, when the insulating housing 20 is pulled by the external connector, the aforesaid connection among the first fixing pin 23, the second fixing pin 24 and the circuit board 1 is capable of preventing solders between the signal connecting portion 211 of each of the signal contact 21' and the circuit board 1 and between the ground connecting portion 221 of the ground contact 22 and the circuit board 1 from cracking, so as to further prevent the connector 2 from separating from the circuit board 1.

It should be noticed that the distance D2 between the end 2320 of the first embedding portion 232 and the edge 2302 of the plate structure and the distance D4 between the end 2420 of the second embedding portion 242 and the edge 2402 of the sheet structure are not limited to those illustrated in figures in this embodiment. In perspective of requirement of the surface mounting technology and the reflow process, the end 2320 of the first embedding portion 232 and the end 2420 of the second embedding portion 242 can protrude from the second board side 11 of the circuit board 1 by limitation of 0.5 mm. In other words, the distance D2 between the end 2320 of the first embedding portion 232 and the edge 2302 of the plate structure and the distance D4 between the end 2420 of the second embedding portion 242 and the edge 2402 of the sheet structure can be substantially equal to 2.1 mm (i.e. sum of the thickness of the circuit board 1 and the aforesaid limitation of 0.5 mm). As for which one of the above-mentioned designs is adopted, it depends on practical demands.

As shown in FIG. 6, a distance D5 between a geometric center of the first containing slot 2010 of the insulating housing 20 and the third lateral wall 203 is substantially equal to a distance D6 between a geometric center of the first containing slot 2010 and the fourth lateral wall 204, i.e. the first containing slot 2010 is formed in the middle of the first lateral wall 201. Accordingly, the first fixing pin 23 is disposed in the middle of the first lateral wall 201. When the insulating housing 20 is applied by forces along different directions (i.e. the forces F1, F2 shown in FIG. 6 and FIG. 7), the structure that the distance between the first containing slot 2010 and the third lateral wall 203 is equal to the distance between the first containing slot 2010 and the fourth lateral wall 204 results in that a reverse force generated by the first fixing pin 23 for resisting the force F1 is substantially equal to a reverse force generated by the first fixing pin 23 for resisting the force F2, such that the first fixing pin 23 results in that the structural length of the first fixing pin 23 for the signal contact set 21 is the same as the structure length of the first fixing pin 23 for the ground contact 22.

Namely, a distance D7 between a geometric center of the second containing slot 2020 of the insulating housing 20 and the third lateral wall 203 is substantially equal to a distance D8 between a geometric center of the second containing slot 2020 and the fourth lateral wall 204, i.e. the second containing slot 2020 is formed in the middle of the second lateral wall 202. Accordingly, the second fixing pin 24 is disposed in the middle of the second lateral wall 202. The principle of the second containing slot 2020 and the second fixing pin 24 is identical to that of the first containing slot 2010 and the first fixing pin 23, and the related description is omitted herein for simplicity.

Compared to the prior art, the present invention determines the length of the first fixing pin and the length of the second fixing pin according to the thickness of the circuit board, such that the connector is able to fix onto the circuit board in a Surface Mount Technology manner and by reflow process for saving hours of assembling the connector and the circuit board. In addition, the present invention utilizes the first fixing pin and the second fixing pin for inserting into the first mating hole and the second mating hole, and the first embedding portion of the first fixing pin and the second embedding portion of the second fixing pin are soldered to fix in the first mating hole and the second mating hole. As a result, the first fixing pin and the second fixing pin are capable of enhancing connection strength between the insulating housing and the circuit board, so as to facilitate the insulating housing to resist against pulling. The aforesaid connection among the first fixing pin, the second fixing pin and the circuit board is capable of preventing solders between the signal connecting portion of each of the signal contact and the circuit board and between the ground connecting portion of the ground contact and the circuit board from cracking, so as to further prevent the connector from separating from the circuit board.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector adapted to a circuit board, comprising:

an insulating housing whereon a first containing slot and a second containing slot are formed, the insulating housing comprising a first engaging structure located in the first containing slot and a second engaging structure located in the second containing slot;

a signal contact set installed inside the insulating housing;

a ground contact installed inside the insulating housing and opposite to the signal contact set; and a first fixing pin installed inside the insulating housing and located between the signal contact set and the ground contact, the first fixing pin comprising:

a first main body installed in the first containing slot;

a first latching portion for latching the first engaging structure; and a first embedding portion extending from the first main body and being for embedding into a first mating hole on the circuit board; and a second fixing pin installed inside the insulating housing, located between the signal contact set and the ground contact and corresponding to the first fixing pin, the second fixing pin comprising:

a second main body installed in the second containing slot;

a second latching portion for latching the second engaging structure; and a second embedding portion extending from the second main body and being for embedding into a second mating hole on the circuit board.

2. The connector of claim 1, wherein a first positioning slot is further formed on the insulating housing and communicates with the first containing slot, and the first fixing pin further comprises:

a positioning structure protruding from the first main body, the positioning structure cooperating with the first positioning slot, so as to position the first main body in the first containing slot.

3. The connector of claim 2, wherein the first main body is substantially a plate structure, the first latching portion and the positioning structure respectively protrude from and are perpendicular to the plate structure, and the first embedding portion is coplanar with the plate structure.

4. The connector of claim 3, wherein a distance between a top surface of the first latching portion and a top surface of the plate structure is between 0.2 mm and 0.35 mm, and a distance between an end of the first embedding portion and an edge of the plate structure is between 1.4 mm and 1.42 mm.

5. The connector of claim 2, wherein a second positioning slot is further formed on the insulating housing and communicates with the second containing slot, and the second fixing pin further comprises:

a constraining structure protruding from the second main body, the constraining structure cooperating with the second positioning slot, so as to constrain the second main body in the second containing slot.

6. The connector of claim 5, wherein the second main body is substantially a sheet structure, the second latching portion and the constraining structure respectively protrude from and are perpendicular to the sheet structure, and the second embedding portion is coplanar with the sheet structure.

7. The connector of claim 6, wherein a distance between a top surface of the second latching portion and a top surface of the sheet structure is between 0.2 mm and 0.35 mm, and a distance between an end of the second embedding portion and an edge of the sheet structure is between 1.4 mm and 1.42 mm.

8. The connector of claim 1, wherein a length of the first embedding portion is smaller than a thickness of the circuit board, and a length of the second embedding portion is smaller than the thickness of the circuit board.

9. The connector of claim 1, wherein the insulating housing has a first lateral wall, a second lateral wall, a third lateral wall and a fourth lateral wall, the first lateral wall is opposite to the second lateral wall, the third lateral wall connects the first lateral wall and the second lateral wall, the fourth lateral wall connects the first lateral wall and the second lateral wall and is opposite to the third lateral wall, the first lateral wall, the second lateral wall, the third lateral wall and the fourth lateral wall cooperatively define a mating opening, which is for mating with an external connector.

10. The connector of claim 9, wherein the first containing slot is located on the first lateral wall, the second containing slot is located on the second lateral wall, a third containing slot is formed on the third lateral wall and for containing the signal contact set, a fourth containing slot is formed on the fourth lateral wall and for containing the ground contact, and the mating opening communicates with the first containing slot, the second containing slot, the third containing slot and the fourth containing slot.

11. The connector of claim 10, wherein a buckling hole is formed on the third lateral wall, and the connector further comprises:

an installing base combined with the signal contact set, the installing base assembling the signal contact set into the third containing slot and having a buckling structure for buckling the buckling hole.

12. The connector of claim 11, wherein the insulation housing has a first edge and a second edge opposite to the first edge, and each signal contact of the signal contact set comprises:

a signal abutting portion extending from the first edge, stretching into the mating opening via the third containing slot and for electrically connected to an external contact of the external connector; and a signal connecting portion connected to the signal abutting portion, extending outward from the second edge and for electrically connected to a signal pad on the circuit board.

13. The connector of claim 10, wherein the ground contact comprises:

a ground abutting portion stretching into the mating opening via the fourth containing slot; and a ground connecting portion connected to the ground abutting portion and for electrically connected to a ground pad on the circuit board.

14. The connector of claim 13, wherein an engaging hole is formed on the ground abutting portion, and the fourth lateral wall has an engaging protrusion for engaging with the engaging hole.

15. The connector of claim 13, wherein the ground abutting portion has at least one inserting structure for inserting into a slot wall of the fourth containing slot.

16. The connector of claim 10, wherein a distance between the first containing slot and the third lateral wall is substantially equal to a distance between the first containing slot and the fourth lateral wall, and a distance between the second containing slot and the third lateral wall is substantially equal to a distance between the second containing slot and the fourth lateral wall.

17. A connecting port assembly, comprising:

a circuit board having a first board side, a first mating hole and a second mating hole being formed on the circuit board; and a connector disposed on the first board side, comprising:

an insulating housing whereon a first containing slot and a second containing slot are formed, the insulating housing comprising a first engaging structure located in the first containing slot and a second engaging structure located in the second containing slot;

a signal contact set installed inside the insulating housing;

a ground contact installed inside the insulating housing and opposite to the signal contact set;

a first fixing pin installed inside the insulating housing and located between the signal contact set and the ground contact, the first fixing pin comprising:

a first main body installed in the first containing slot;

a first latching portion protruding from the first main body and being for latching the first engaging structure; and a first embedding portion extending from the first main body and being for embedding into the first mating hole on the circuit board; and a second fixing pin installed inside the insulating housing, located between the signal contact set and the ground contact and corresponding to the first fixing pin, the second fixing pin comprising:

a second main body installed in the second containing slot;

a second latching portion protruding from the second main body and being for latching the second engaging structure; and a second embedding portion extending from the second main body and being for embedding into the second mating hole on the circuit board.

18. The connecting port assembly of claim 17, wherein the insulating housing has a first lateral wall, a second lateral wall, a third lateral wall and a fourth lateral wall, the first lateral wall is opposite to the second lateral wall, the third lateral wall connects the first lateral wall and the second lateral wall, the fourth lateral wall connects the first lateral wall and the second lateral wall and is opposite to the third lateral wall, the first lateral wall, the second lateral wall, the third lateral wall and the fourth lateral wall cooperatively define a mating opening, which is for mating with an external connector, the first containing slot is located on the first lateral wall, the second containing slot is located on the second lateral wall, a third containing slot is formed on the third lateral wall and for containing the signal contact set, a fourth containing slot is formed on the fourth lateral wall and for containing the ground contact, and the mating opening communicates with the first containing slot, the second containing slot, the third containing slot and the fourth containing slot.

19. The connecting port assembly of claim 18, wherein the circuit board further has a second board side opposite to the first board side, the circuit board comprises a switch pad on the second board side, and the first mating hole and the second mating hole are located near the switch pad, the circuit board further comprises a signal pad and a ground pad on the first board side, the signal pad and the ground pad are located near a position where the switch pad is projected to the first board side, each signal contact of the signal contact set comprises a signal abutting portion and a signal connecting portion, the signal abutting portion stretches into the mating opening via the third containing slot and is for electrically connected to an external contact of the external connector, the signal connecting portion is connected to the signal abutting portion and for electrically connected to a signal pad on the circuit board, the ground contact comprises a ground abutting portion and a ground connecting portion, the ground abutting portion stretches into the mating opening via the fourth containing slot, the ground connecting portion connecting portion is connected to the ground abutting portion and for electrically connected to the ground pad on the circuit board.

20. The connecting port assembly of claim 17, wherein the first main body is substantially a plate structure, the first latching portion and the positioning structure are perpendicular to the plate structure, the first embedding portion is coplanar with the plate structure, a distance between an end of the first embedding portion and an edge of the plate structure is smaller than a thickness of the circuit board, the second main body is substantially a sheet structure, the second latching portion and the constraining structure respectively protrude from and are perpendicular to the sheet structure, the second embedding portion is coplanar with the sheet structure, and a distance between an end of the first embedding portion and an edge of the plate structure is smaller than the thickness of the circuit board.

* * * * *